US005117158A

United States Patent [19]

Arbel

[11] Patent Number: 5,117,158

[45] Date of Patent: May 26, 1992

[54] ELECTRONIC BALLAST FOR FLUORESCENT LIGHTS

[76] Inventor: Abe Arbel, 2444 Benny Crescent, #208, Montreal, Quebec, Canada, H4B 2R3

[21] Appl. No.: 650,282

[22] Filed: Feb. 4, 1991

[51] Int. Cl.[5] ..... H05B 41/14

[52] U.S. Cl. ..... 315/220; 315/226; 315/277; 315/278; 315/324; 315/DIG. 5

[58] Field of Search ..... 315/209 R, 210, 219, 315/220, 222, 226, 276, 277, 278, 324, DIG. 7, DIG. 9, DIG. 5

[56] References Cited

U.S. PATENT DOCUMENTS 4,353,010 10/1982 Knoll et al. ..... 315/220
4,415,839 11/1983 Lesea ..... 315/216 X
4,698,554 10/1987 Stupp et al. ..... 315/205 X

*Primary Examiner*—David Mis
*Attorney, Agent, or Firm*—Chilton, Alix & Van Kirk

[57] ABSTRACT

The ballast is connected between the fluorescent lights and a source of power for the fluorescent lights. The source of power provides an input signal having a first waveform, usually a sine wave, at a first frequency. The ballast consists of a converter for coverting the first waveform to a second waveform at a second frequency different from the first frequency. A distribution arrangement distributes power to the fluorescent lights. The distribution system consists of a transformer, and capacitors are interposed between selected windings of the secondary of the transformer. In one embodiment, the sine wave is converted to a square wave by the converter and to a saw tooth waveform by the capacitors in the distribution arrangement so that the fluorescent lights are fed with the saw tooth waveform.

13 Claims, 2 Drawing Sheets

ELECTRONIC BALLAST FOR FLUORESCENT LIGHTS

BACKGROUND OF INVENTION

1. Field of the Invention

The invention relates to an electronic ballast for fluorescent lights. More specifically, the invention relates to such a ballast which reduces energy consumption of the fluorescent lights.

2. Description of Prior Art

Presently available ballasts typically consist of nothing more than a transformer having a capacitor in the secondary. The transformer is a 1:1 transformer and is provided for the purpose of redistributing the energy so that, for example, two lights can be fed in series instead of in parallel. The fluorescent lights are fed with the power of the mains, for example, 120 volts 60 Hz, 120 volts 50 Hz, etc., i.e., whatever standards are employed in the mains in different countries of the world.

The capacitor is provided to distort the leading part of the sine wave cycle so that the leading part is steeper and thereby provides a rapid start for the fluorescent lights.

The problem with presently available ballast is that, with the use of such ballast, the fluorescent lights consume a relatively large amount of energy.

SUMMARY OF INVENTION

It is therefore an object of the invention to provide an electronic ballast for fluorescent lights.

It is a more specific object of the invention to provide such an electronic ballast which reduces the consumption of energy in the fluorescent lights.

In accordance with the invention, the electronic ballast converts the sine wave of the mains which oscillates at a first frequency to a different shaped waveform which oscillates at a second higher frequency. The different shaped waveform at the higher frequency provides the driving energy for the fluorescent lights, at a power factor greater than 90%.

In a particular embodiment, the sine wave is converted first to a square wave at the higher frequency and then to a saw tooth, the saw tooth then providing the driving energy for the fluorescent lights.

The second higher frequency is at least 1 KHz and preferably in the range of 10 to 18 KHz. In a particularly preferred embodiment, the selected second higher frequency was 14 KHz.

In accordance with a particular embodiment of the invention there is provided an electronic ballast for a fluorescent light means, said ballast being connected between said fluorescent light means and a source of power for said fluorescent light means, said source of power providing an input signal having a first waveform at a first frequency, said fluorescent light means having input means;

said ballast comprising:

waveform converter means, having input means connected to said source of power and output means, for converting said first waveform to a second waveform at a second frequency higher than said first frequency; and a distribution arrangement for distributing power to said fluorescent light means, said distribution arrangment having input means connected to the output means of said converter means, and output means connected to the input means of said fluorescent light means.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
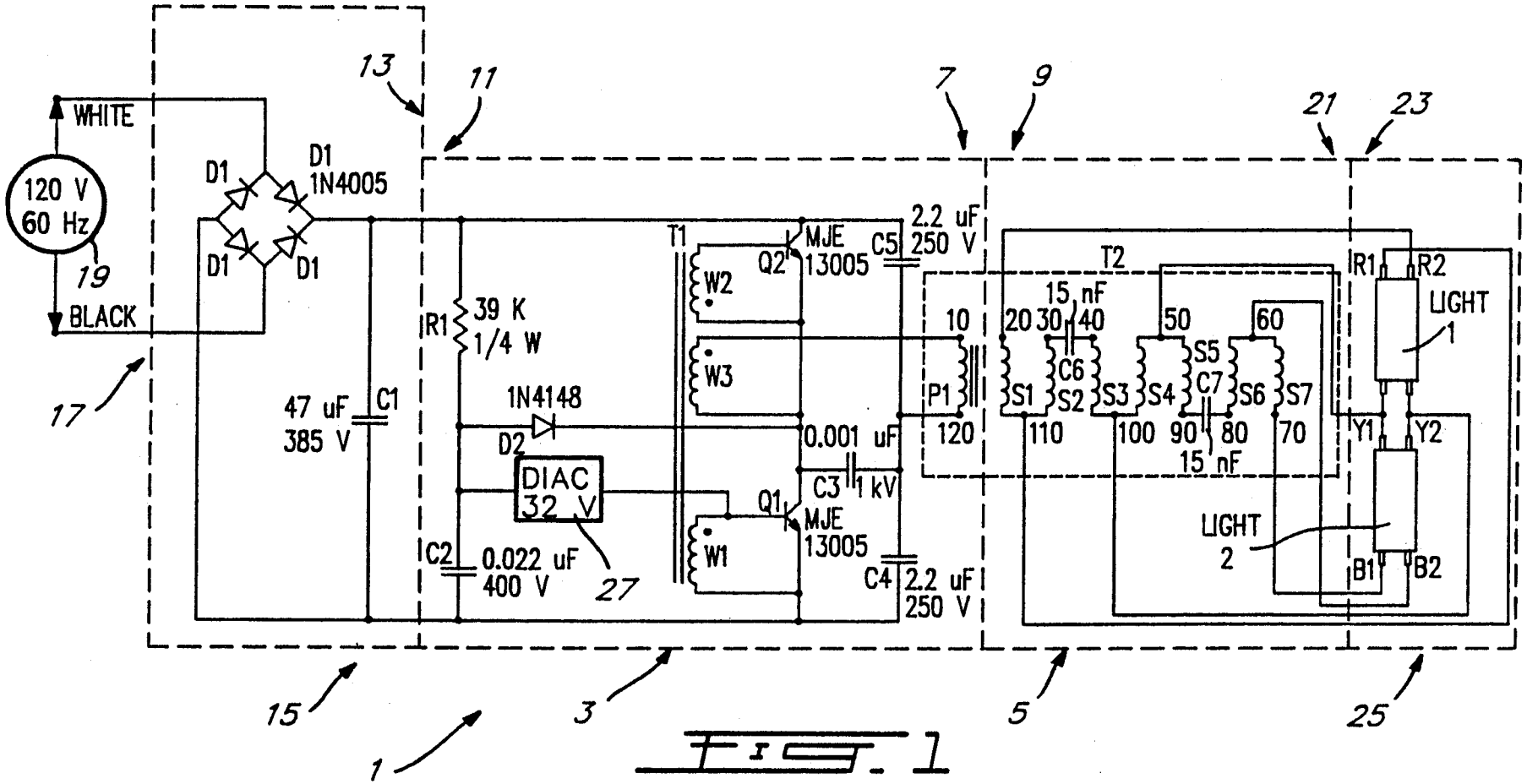
FIG. 1 is a circuit diagram of a particular embodiment of the invention.

Referring to FIG. 1, the ballast, indicated generally at 1, comprises a waveform converter means, in the illustrated embodiment, a square wave generator means 3 and a distribution arrangement 5. The output side 7 of the square wave generator means 3 is connected to the input side 9 of the distribution arrangement 5. The input side 11 of the square wave generator means 3 is fed to the output side 13 of a rectifier 15, which also comprises part of the waveform converter means. The input side 17 of the rectifier 15 is connected to a source of driving energy 19, for example, a power mains. As is well known to one skilled in the art, the power mains will supply a sine wave of 120 volts at 60 Hz in North America. In Europe, it will supply a sine wave of 240 volts at 50 Hz. In addition the mains may supply sine waves of 347 volts at 60 or 50 Hz. The particular voltage or frequency supplied at the mains is not a factor in the operation of the inventive ballast which will operate, with appropriate selection of circuit parameter values, regardless of the voltage and frequency at the mains.

The output side 21 of the distribution arrangement 5 is fed to the input side 23 of fluorescent light means 25. In the illustrated embodiment, the fluorescent light means 25 comprises two fluorescent lights in series.

As can be seen, the rectifier 15 comprises four diodes D1 and a capacitor C1 connected in a well known arrangement. The square wave generator means 3 comprises an RC circuit consisting of resistor R1 and capacitor C2. The RC circuit sets the frequency of the generated square wave.

Connected at the junction of R1 and C2 is a diac 27. Diode D2 is also connected at the junction of R1 and C2.

The square wave generator means 3 also includes a transformer T1 which has two primaries W1 and W2 and a secondary W3. The secondary W3 is connected in in-phase relationship with the primary W1, and in out-of-phase relationship with the primary W2.

One end of primary W1 is connected to the base of a transistor Q1, and the other end of the primary W1 is connected to the emitter of Q1. In a like manner, one end of the primary W2 is connected to the base of transistor Q2, and the other end of W2 is connected to the emitter of Q2.

The secondary W3 is connected to the primary P1 of a second transformer T2. A capacitor C5 is connected between the collector of Q2 and one end of the primary P1, and a capacitor C4 is connected between the emitter of Q1 and the same one end of the primary P1. A capacitor C3 is connected between the collector of Q1 and the same one end of the primary P1.

The secondary of T2 comprises a plurality of windings with taps being disposed between selected ones of the plurality of windings, and capacitors being connected between selected other ones of the plurality of windings. Thus, a tap is connected between windings S1 and S2 at point 110, and a second tap is connected between windings S3 and S4 at point 100. A third tap is connected between windings S4 and S5 at point 50 and a fourth tap is connected between windings S6 and S7 at point 60. The secondary of T2 and the interconnected taps and capacitors comprise the distribution arrangement 5.

One end 20 of the secondary is connected to an input R2 of light 1 and the other end 70 of the secondary is connected to terminal B1 of light 2. The first tap is connected to terminal R1 of light 1 and a second tap is connected to terminal Y2 of lights 1 and 2. The third tap is connected to terminal Y1 of lights 1 and 2, and the fourth tap is connected to terminal B2 of light 2. It can be seen that the two lights are connected in series with differing amounts of power being connected to the different terminals.

Capacitor C6 is connected between windings S2 and S3, and capacitor C7 is connected between windings S5 and S6. With the component values as shown in the drawings, and with the following number of turns in the windings of T2, a saw tooth of 14 KHz comprises the input to the luminescent light means:

P1: 36 turns
S1: 2 turns
S2: 39 turns
S3: 39 turns
S4: 2 turns
S5: 39 turns
S6: 39 turns
S7: 2 turns.

With the illustrated arrangement, it was determined that the consumption per luminescent light is 200 milliamps. In order to obtain the same light intensity with a ballast of the prior art, an energy consumption of 400 milliamps per light is required.

In operation, the ballast works as follows:

The input power sine wave is rectified by the rectifier 15 to provide a DC level as is well known in the art. Capacitor C2 is charged through the resistor R1 until the voltage across C2 is equal to the turn on voltage of the diac 27 (32 volts in the illustrated example). The same 32 volts is the bias voltage for transistor Q1 so that, when diac 27 is turned on, transistor Q1 is biased on and the voltage across winding W1 rises to 32 volts. The voltage in winding W3, which is in phase with the windings in W1, also rises to cause the voltage of input windings P1 of the transformer T2 to rise to its maximum value in phase with the windings W1.

Figure 2:
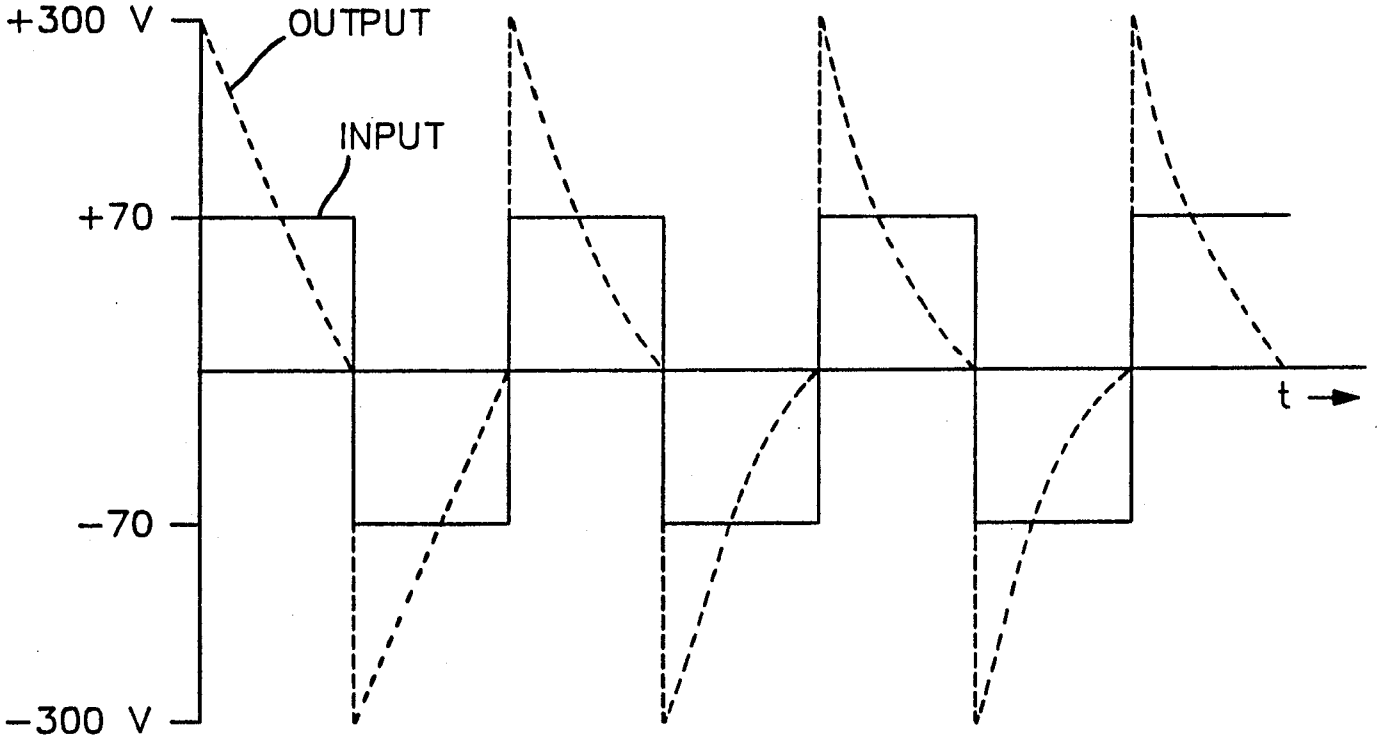
FIG. 2 is a graph showing the waveform at the input of the distribution system in FIG. 1 and the waveform at the output of the distribution system, that is, the input to the fluorescent lights, in FIG. 1.

With transistor Q1 conducting, capacitor C2 discharges through diode D2 and the transistor so that the voltage across the winding W1 collapses thus turning the transistor Q1 off and also reversing the voltages in windings W2 and W3 of transformer T1. The falling voltage of W3 is connected to the primary P1 of transformer T2. This completes the positive half of the cycle illustrated in FIG. 2.

With the transistor Q2 turned on, diode D2 ceases to conduct so that capacitor C2 starts to recharge again and the cycle repeats itself.

The frequency of oscillation, in the illustrated embodiment 14 kilohertz, is controlled by the values of R1 and C2 and the number of turns in the windings of transformer T1. The values in the illustrated embodiment are: W1 and W2—15 turns each and W3—2 turns.

The square wave of FIG. 1 is applied to the primary windings P1 of transformer T2 by transistors Q1 and Q2 via windings W3 as above described. The capacitors C3, C4 and C5 ensure that point 120 of the primary windings P1 of the transformer T2 will be maintained at a constant voltage with respect to the square wave fluctuations of the voltage of pin 10 of the same windings P1.

The output voltages of the transformer T2 are calculated to approximately double the input voltage, i.e., double the square wave voltage. The control of the amount of current output to the fluorescent lights and their saw tooth shape are achieved, with practically no resistive losses, by capacitors C6 and C7 in series with the windings. The doubling of the output voltages is achieved by the turn ratio of transformer T2. In this case, as above seen, the turn ratio is 36:78.

The fluorescent lights also require potential drops between the pins at each end of the lights. This is achieved by proper design of transformer T2 and, in the illustrated embodiment, two turns are inserted in series with the windings supplying power to each light. Specifically, the two turns are provided by windings S1, S4 and S7. The lights are connected in series with each other and windings S4, S5, S6 and S7 supply power to the lights.

With the inventive arrangement, the fluorescent lights will be turned on rapidly regardless of the specifications of the lights.

Although a particular embodiment has been illustrated, this was for the purpose of describing, but not limiting, the invention. Various modifications, which will come readily to the mind of one skilled in the art, are within the scope of the invention as defined in the appended claims.

I claim:

1. An electronic ballast for a fluorescent light means, said ballast being connected between said fluorescent light means and a source of power for said fluorescent light means, said source of power providing an input voltage having a sinusoidal waveform at a first frequency, said fluorescent light means having input means;

said ballast comprising:

waveform converter means for converting said sinusoidal waveform voltage to a square wave voltage at a second frequency higher than said first frequency, said converter means having input means connected to said source of power and output means; and distributor means for distributing power to said fluorescent light means, said distributor means having input means connected to the output means of said converter means, said distributor means also having output means connected to the input means of said fluorescent light means;

said distributor means comprising means for converting said square wave voltage to a saw-tooth wave voltage, said saw-tooth wave voltage having a sharp rise at the leading edge of each cycle thereof.

2. A ballast as defined in claim 1 wherein said waveform converter means comprises rectifier means, said rectifier means having input means connected to said source of power and output means, said rectifier means converting said sinusoidal waveform input voltage to a DC signal.

3. A ballast as defined in claim 2 wherein said converter means further includes square wave generator means, having input means connected to the output means of said rectifier means and output means, said output means of said square wave generator means comprising the output means of said converter means, said converter means converting said DC signal to said square wave at said second frequency.

4. A ballast as defined in claim 3 wherein said square wave generator comprises a first transistor and a second transistor;

means for alternately connecting said first transistor and said second transistor to said input means of said distributor means.

5. A ballast as defined in claim 4 wherein said means for alternately connecting comprises a transformer having a first primary, a second primary and a secondary;

said first primary having one end connected to the base of said first transistor and the other end connected to the emitter of said first transistor;

said second primary having one end connected to the base of said second transistor and the other end connected to the emitter of said second transistor;

said secondary being connected in in-phase relationship with said first primary and an out-of-phase relationship with said second primary.

6. A ballast as defined in claim 5 wherein said square wave generator further comprises an RC circuit connected across the output means of said rectifier means;

a diac, having an input and an output, said input of said diac being connected to the junction of said RC circuit, and said output of said diac being connected to one end of said first primary.

7. A ballast as defined in claim 6 wherein said square wave generator further comprises a first maintaining capacitor connected, at one end thereof, to the emitter of said first transistor;

a second maintaining capacitor, connected, at one end thereof, to the collector of said second transistor;

the second ends of said first and second maintaining capacitors being connected to each other;

a third maintaining capacitor connected between the collector of said first transistor and the junction of said first maintaining capacitor and said second maintaining capacitor.

8. A ballast as defined in claim 7 wherein the collector of said first transistor is connected to the emitter of said second transistor;

one end of the secondary of said first transformer being connected to the junction of said collector of said first transistor and said emitter of said second transistor.

9. A ballast as defined in claim 8 wherein the output means of said converter means comprises a primary of a second transformer, one end of said primary of said second transformer being connected to the other end of said secondary of said first transformer, the other end of the primary of said second transformer being connected to the junction of said first maintaining capacitor and said second maintaining capacitor;

said input means of said distributor means comprising the secondary of said second transformer, said secondary of said second transformer comprising a plurality of windings;

a plurality of tap means connected between selected ones of said plurality of windings of said secondary of said second transformer;

said tap means comprising said output means of said distributor means;

a plurality of capacitors connected between other ones of said plurality of windings of said secondary of said second transformer;

whereby, the waveform of the voltage applied to said fluorescent light means comprises said saw-tooth waveform at said second frequency.

10. A ballast as defined in claim 9 wherein driving energy is provided to said fluorescent light means at a power factor greater than 90%.

11. A ballast as defined in claim 10 wherein said second frequency is greater than 1 KHz.

12. A ballast as defined in claim 11 wherein said frequency is between 10 and 18 KHz.

13. A ballast as defined in claim 12 wherein said second frequency 14 KHz.

* * * * *